US007481468B2

(12) United States Patent
Merideth et al.

(10) Patent No.: US 7,481,468 B2
(45) Date of Patent: Jan. 27, 2009

(54) APPARATUS FOR BLOCKING THE MOVEMENT OF AN INERTIALLY ACTIVATED COMPONENT

(75) Inventors: Marcus Merideth, Westland, MI (US); Kelly Kohlstrand, Grosse lle, MI (US); James Loschiavo, Livonia, MI (US); Venky Krishnan, Wayne, MI (US); Mahmoud Ghannam, Windsor (CA)

(73) Assignee: Ford Global Technologies, LLC, Dearborn, MI (US)

( * ) Notice: Subject to any disclaimer, the term of this patent is extended or adjusted under 35 U.S.C. 154(b) by 80 days.

(21) Appl. No.: 11/588,194

(22) Filed: Oct. 25, 2006

(65) Prior Publication Data

US 2008/0111381 A1 May 15, 2008

(51) Int. Cl.
*E05C 1/02* (2006.01)
*E05C 1/08* (2006.01)

(52) U.S. Cl. ..... 292/137; 292/163; 292/183; 292/189; 292/230; 292/DIG. 22; 292/DIG. 65

(58) Field of Classification Search ..... 292/137, 292/163, 183, 184, 189, 230, DIG. 22, DIG. 26, 292/DIG. 65; 180/286
See application file for complete search history.

(56) References Cited

U.S. PATENT DOCUMENTS

| | | | | |
|---|---|---|---|---|
| 32,990 | A * | 8/1861 | Ellis | 292/230 |
| 3,583,741 | A | 6/1971 | Breitschwerdt | 292/216 |
| 3,799,596 | A * | 3/1974 | Nozomu et al. | 292/216 |
| 5,690,371 | A * | 11/1997 | Turnbull | 292/163 |
| 5,865,481 | A | 2/1999 | Buschmann | 292/216 |
| 6,099,052 | A | 8/2000 | Spitzley | 292/336.3 |
| 6,648,382 | B1 | 11/2003 | Monig | 292/336.3 |
| 2005/0184537 | A1 | 8/2005 | Le | 292/336.3 |
| 2006/0237973 | A1 * | 10/2006 | Anguila | 292/92 |
| 2006/0261602 | A1 * | 11/2006 | Jankowski et al. | 292/216 |
| 2006/0261603 | A1 * | 11/2006 | Cetnar et al. | 292/216 |
| 2007/0085349 | A1 * | 4/2007 | Merideth et al. | 292/183 |

* cited by examiner

*Primary Examiner*—Carlos Lugo
(74) *Attorney, Agent, or Firm*—Gregory Brown; Miller Law Group, PLLC

(57) ABSTRACT

A blocking apparatus is cooperable with the latch lever of a vehicle door latching mechanism to prevent the latch lever from moving during a crash event, which prevents the latching mechanism from allowing the vehicle door to open. The blocking apparatus includes a housing supporting a linearly movable plunger engagable with a cam surface on the latch lever and a blocking member pivotally mounted for movement between a normal position and a blocking position. The blocking member moves into the blocking position due to the imposition of crash forces on the blocking member during a crash event. A centering spring mechanism biases the blocking member into the normal position and can return the blocking member into the normal position to permit movement of the latch lever after the crash event has occurred. The plunger is biased into engagement with the latch lever so as to move with the cam surface.

11 Claims, 8 Drawing Sheets

APPARATUS FOR BLOCKING THE MOVEMENT OF AN INERTIALLY ACTIVATED COMPONENT

FIELD OF THE INVENTION

This invention relates to an apparatus that is operable to block the inertial actuated movement of a component in an automobile and, more particularly, to a blocking mechanism that prevents a door latch lever from moving during a crash event.

BACKGROUND OF THE INVENTION

A door on an automobile includes a latching mechanism that has the function of securing the door in a closed position. An actuation device is operable to release the latching mechanism to permit the door to be opened as desired for ingress and egress with respect to the passenger compartment of the automobile. Mechanically actuated latching mechanisms typically include a latch lever that is connected to the actuation lever to move generally linearly in response to a corresponding movement of the actuation lever. Typically, the actuation lever is pivotally supported on the door to affect a release of the latching mechanism.

During a crash event, the momentum of the vehicle can cause the latch lever to move inertially and affect an undesired opening of the latching mechanism. Accordingly, it would be desirable to provide a blocking mechanism that would be operable to prevent the inertially movable latch lever from moving during a crash event, yet allow the normal operation of the latching mechanism to permit the desired opening and closing of the door. It would be further desirable that the blocking mechanism would be operable to reset after the crash event to allow the selective release of the latching mechanism for the opening of the door.

In U.S. Pat. No. 3,583,741, granted to Werner Breitschwerdt on Jun. 8, 1971, a lock arrangement for automotive doors balances the inertial forces incurred during a crash event through force absorbing springs and a weighted pivot lever. A door handle assembly that precludes an inadvertent opening of the latch mechanism upon a side impact crash event is disclosed in U.S. Pat. No. 6,099,052, granted to Larry Spitzley on Aug. 8, 2000.

U.S. Pat. No. 5,865,481, issued to Alexander Buschmann on Feb. 2, 1999, discloses a door latch that is constructed in a manner as to prevent unlatching during a collision. An L-shaped blocking lever is pivotal between blocking and non-blocking positions by means of a spring. The blocking lever is pivoted by inertial forces to come into alignment with a camming point, which causes the latch to stay closed during impact. Similarly, U.S. Pat. No. 6,648,382, granted on Nov. 18, 2003, to Stefan Monig teaches a pivotable latching member secured in position by a torsion spring and a stationary stop in a housing. During a crash event, the inertial forces will overcome the spring force and move the latching member into position where the latching end of the latching member is supported on a support location of the housing to block the movement of the outer door handle.

In U.S. Patent Application Publication No. 2005/018537, published on Aug. 25, 2005, an inertia activated assembly is disclosed to cause the latching mechanism of a vehicle door handle to resist opening from the frame during a crash event. A spring restrains a weight component to be seated against the housing. During a crash event, the weight component is set into motion and will travel outwardly with respect to the cone-shaped hole in the housing and away from the housing.

The weight component along with the locking tab prevents rotation of the pivoting cam to prevent the door latch from being opened.

SUMMARY OF THE INVENTION

It is an object of this invention to overcome the aforementioned disadvantages of the known prior art by providing a blocking apparatus to prevent the movement of a latch lever during a crash event.

It is another object of this invention to provide a blocking apparatus that can reset after the crash event to permit normal operation of the latching mechanism to open the door of the vehicle as desired.

It is still another object of this invention to provide a plunger engagable with the latch lever to restrict movement thereof when a pivoted blocking member is moved out of alignment due to the external application of crash forces.

It is an advantage of this invention that the blocking member is biased by spring forces into alignment with a plunger engaged with the latch lever.

It is another advantage of this invention that the spring forces can recenter the blocking member after being knocked out of alignment from forces incurred during a crash event.

It is a feature of this invention that the latch lever is formed with a cam surface that engages a plunger to cause movement of a plunger in response to the movement of the latch lever while operating the latching mechanism It is another feature of this invention that the blocking mechanism will prevent movement of the latch lever during a crash event by restricting movement of the engaged plunger.

It is still another feature of this invention that the blocking member can be formed in different configurations that are pivotally supported in a housing to move into a plunger blocking position when external crash forces are incurred.

It is still another advantage of this invention that the blocking apparatus can be used with any linearly movable component to block movement thereof during a crash event.

It is a further object of this invention to provide a device to stop the undesired motion of a lever inside a door latch during a crash event that is durable in construction, inexpensive of manufacture, carefree of maintenance, facile in assemblage, and simple and effective in use.

These and other objects, features and advantages are accomplished according to the instant invention by providing a blocking apparatus cooperable with the latch lever of a vehicle door latching mechanism to prevent the latch lever from moving during a crash event, which in turn prevents the latching mechanism from allowing the vehicle door to open. The blocking apparatus includes a housing supporting a linearly movable plunger engagable with a cam surface on the latch lever and a blocking member pivotally mounted for movement between a normal position and a blocking position. The blocking member moves into the blocking position due to the imposition of crash forces on the blocking member during a crash event. A centering spring mechanism biases the blocking member into the normal position and can return the blocking member into the normal position to permit movement of the latch lever after the crash event has occurred. The plunger is biased into engagement with the latch lever so as to move with the cam surface.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
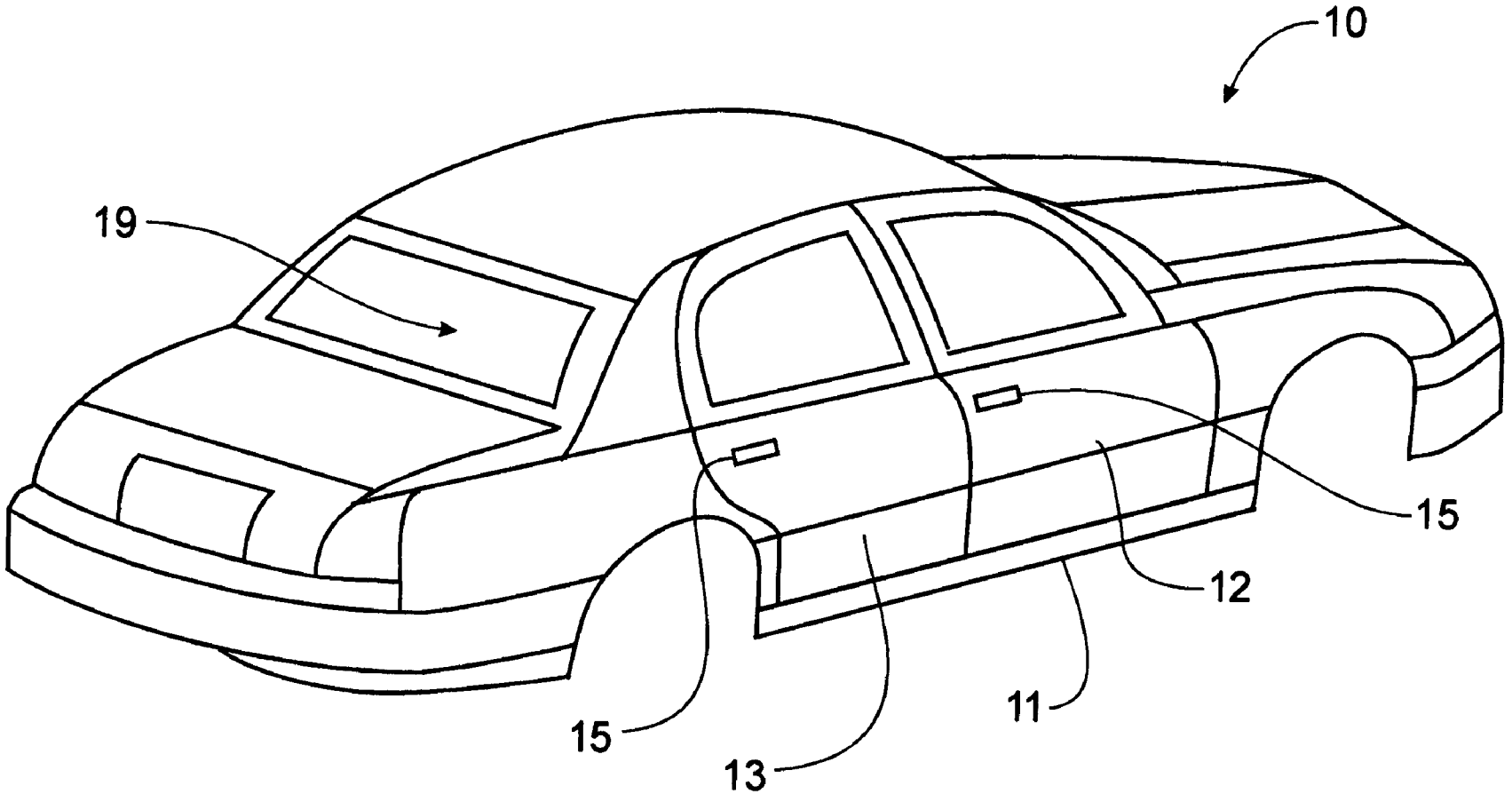
FIG. 1 is a schematic perspective view of an automotive vehicle incorporating the principles of the instant invention.

Referring to FIGS. 1-4, a blocking apparatus for use in an automobile to restrict movement of a door from a closed to an open position during a crash event can best be seen. The automobile 10 is formed with a frame 11 on which are mounted doors, such as the front door 12 and the rear passenger door 13, for movement between a closed position, as depicted in FIG. 1, and an opened position (not shown) in which a passenger can ingress or egress from the interior of the passenger compartment 19 of the vehicle 10. Each of the doors 12, 13 are provided with a door handle 15 that is preferably pivotally mounted on the door 12. The door handle 15 actuates a conventional latching mechanism 20 that controls the latching of the door 12, 13 to the frame 11 of the vehicle 10. The latching mechanism 20 includes a latch lever 22 that moves linearly with the pivotal movement of the door handle 15 to actuate the operation of the latching mechanism 20. The latch lever 22 is preferably formed with a cam surface 25 that moves linearly with the movement of the latch lever 22.

Figure 2:
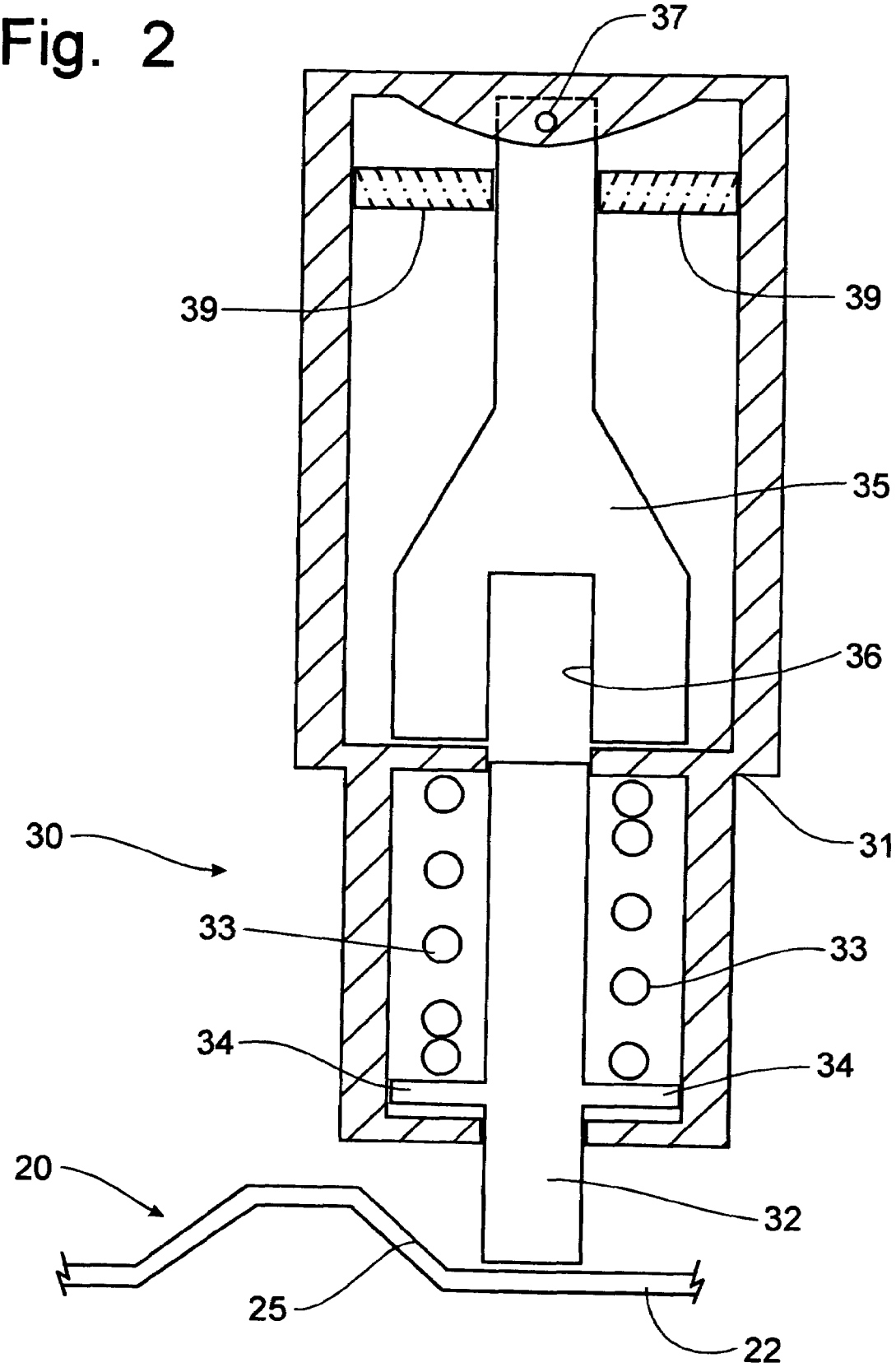
FIG. 2 is a representative cross-sectional view of a first embodiment of a blocking apparatus incorporating the principles of the instant invention, the components being depicted in a normal position corresponding to the door being latched against the frame of the vehicle.
Figure 3:
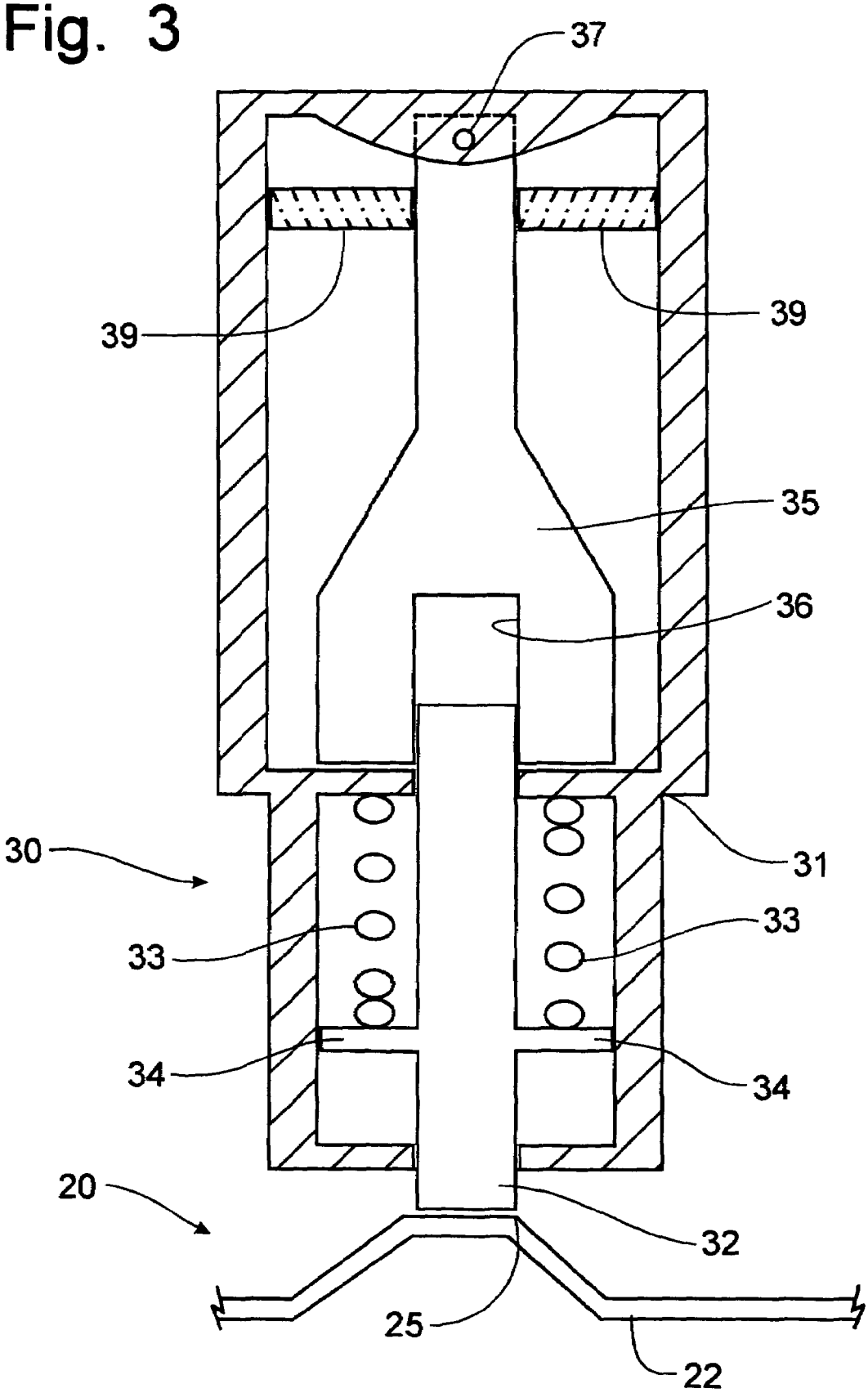
FIG. 3 is a cross-sectional view similar to that of FIG. 2, but showing the movement of the plunger in response to the linear movement of the latch lever while the blocking apparatus is in a normal portion.
Figure 4:
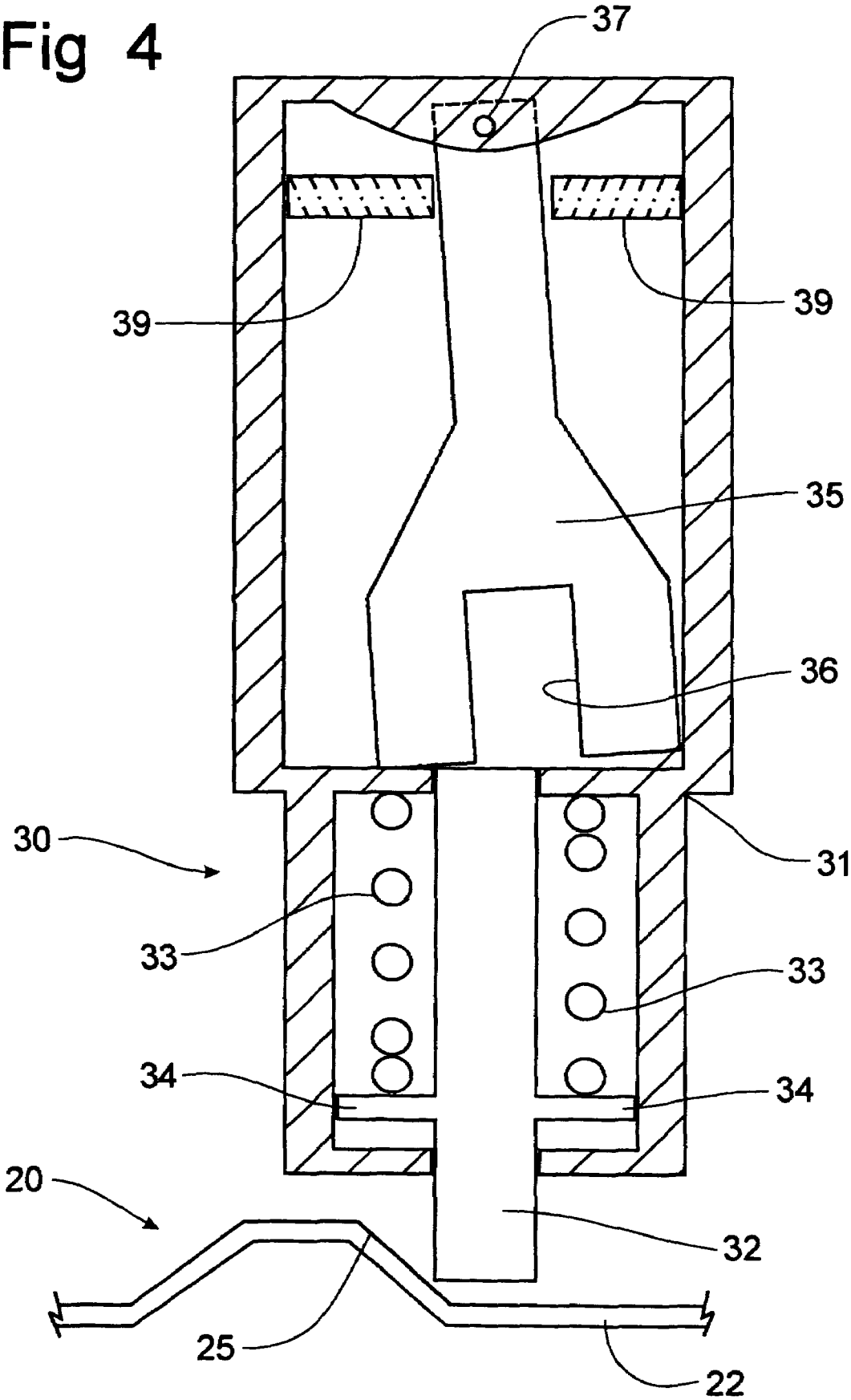
FIG. 4 is a cross-sectional view of the blocking apparatus similar to that of FIG. 2, but showing the inertial mass being pivoted to a blocking position to prevent movement of the plunger and engaged latch lever.

The first embodiment of the blocking apparatus 30 is depicted in FIGS. 2-4. In FIG. 2, the latch lever 22 formed with the cam surface 25 is positioned at a location corresponding to the door 12, 13 being closed and latched against the frame 11. The blocking apparatus 30 is formed with a housing 31 in which is supported a linearly movable plunger 32 that is biased outwardly from the housing 31 by a spring 33. A flange 34 on the plunger 32 prevents the plunger 32 from being pushed out of the housing 31 and provides a seat for the compression spring 33 to exert a biasing force on the plunger 32. The plunger 32 is based against the latch lever 22 and moves into the housing 31 due to engagement with the cam surface 25 when the latch lever 22 is moved linearly, as is represented in FIG. 3.

One skilled in the art will readily recognize that the latch lever 22 is a movable member that causes the plunger 32 to move inwardly into the housing 31 when the latching mechanism 20 is actuated. The latch lever 22 could be pivotally movable, as well as linearly movable, so long as a cam surface 25 of some configuration engages the plunger 32 to force the plunger 32 into the housing 31 upon the movement of the latch lever 22.

The housing 31 also pivotally supports an inertial mass member 35 from the pivot 37. The inertial member 35 has a cavity 36 formed therein for the insertion of the plunger 32 when the cam surface 25 pushes the plunger 32 into the housing, as is depicted in FIG. 3. A centering spring 39 biases the inertial member 35 toward a normal position, as depicted in FIGS. 2 and 3 wherein the cavity 36 is aligned with the plunger 32 to allow movement of the latch lever 22 in response to the actuation of the door handle 15.

As is shown in FIG. 4, the inertial member 35 is pivoted into a blocking position in which the cavity 36 is not aligned with the plunger 32, thus preventing the plunger 32 from moving inwardly with respect to the housing 31. The movement of the inertial member 35 into the blocking position depicted in FIG. 4 can be caused by the application of external crash forces which result in the pivoting of the inertial member 35. Thus, during a crash event, the inertial member 35 pivots to one side or the other taking the cavity 36 out of alignment with the plunger 32. The latch lever 22 is then prevented from moving as the cam surface 25 cannot push the plunger 32 into the housing 31, as the inertial member is blocking the movement of the plunger 32. When the crash event is over, assuming that the housing 31 has not been damaged and that the inertial member 35 is free to move within the housing 31, the inertial member 35 will be returned to the normal position, as is depicted in FIGS. 2 and 3, by the centering springs 39 to permit the door latching mechanism to be operated again. If the crash event occurs while the latching mechanism is actuated, with the latch lever pushing the plunger 32 into the housing 31, the insertion of the plunger 32 into the cavity 36 prevents the inertial member 35 from pivoting.

Figure 5:
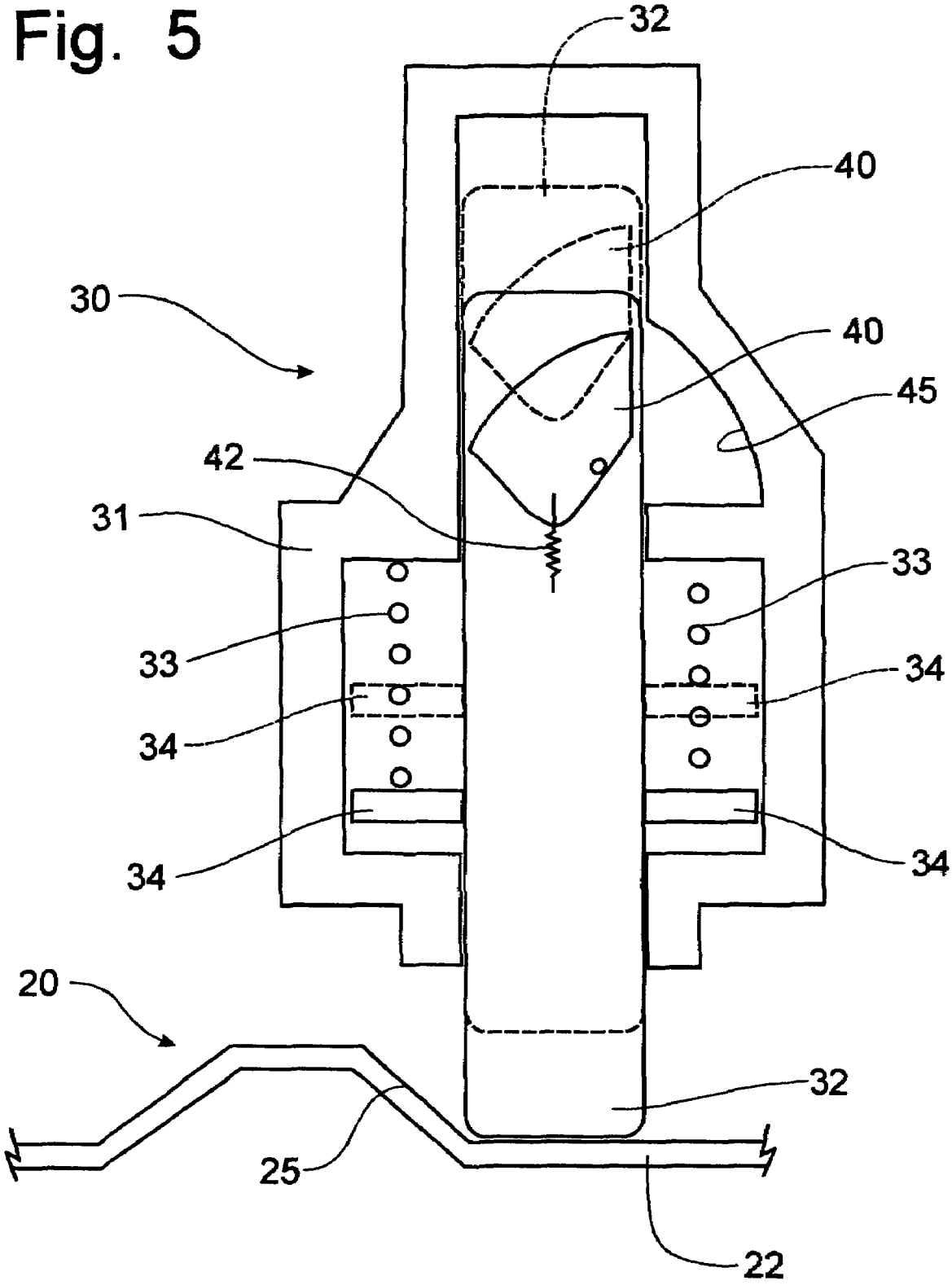
FIG. 5 is a cross-sectional view of a second embodiment of a blocking apparatus in the normal operative position, as depicted in FIG. 2, the movement of the plunger in response to the engagement with the latch lever being shown in phantom.
Figure 6:
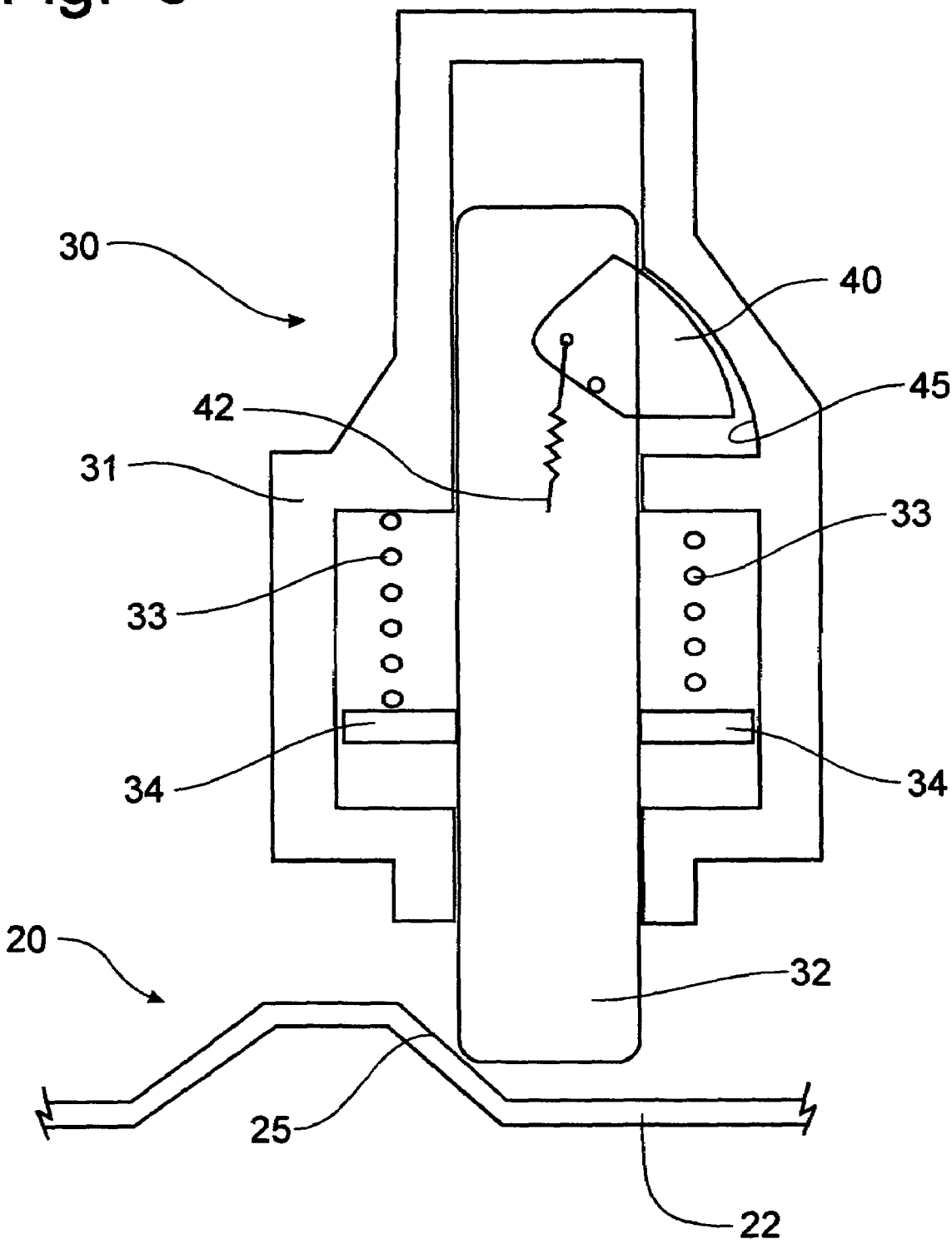
FIG. 6 is a cross-sectional view of the embodiment depicted in FIG. 5, but with the inertial lever pivoted into a blocking position to prevent movement of the plunger and engaged latch lever.

A second embodiment of the blocking apparatus 30 can be seen in FIGS. 5 and 6. The housing 31 is a little more compact than is required for the first embodiment, but also supports the plunger 32 for linear movement inwardly into the housing 31 due to engagement with the cam surface 25 of the latch lever 22. The spring 34 is seated on the plunger flanges 34 to bias the plunger 32 against the housing 31 into engagement with the latch lever 22. During normal operation, the plunger 32 slides into the housing 31 due to engagement with the cam surface 25 to allow movement of the latch lever and normal operation of the door latching mechanism 20.

As is depicted in FIGS. 5 and 6, the plunger supports a pivotally mounted inertial lever 40 that is retained within the confines of the plunger 32 by a retention spring 42. When a crash event occurs, the external crash forces cause the biasing forces exerted by the retention spring 42 to be overcome and pivot the inertial lever 40 out of the confines of the plunger 32 to move into a pocket 45 formed into the housing 31 to receive the pivoting inertial lever 40. Once the crash event has subsided, the retention spring 42 is operable to retract the inertial lever 40 back into the plunger 32 to permit normal operation of the plunger 32 and engaged latching mechanism 20.

The normal opening and closing of the door 12, 13 is not affected by the blocking apparatus 30, as the pulling of the door handle 15 pushes the cam surface 25 into engagement with the plunger 32 to push the plunger 32 into housing 31. With the first embodiment depicted in FIGS. 2-4, the plunger 32 will be inserted into the cavity 36 with the actuation of the door handle 15 to prevent the inertial member 35 from moving and restricting operation of the latching mechanism 20. With the second embodiment depicted in FIGS. 5 and 6, the plunger 32 moves into the cavity 46 formed in the housing 31 to prevent the inertial lever 40 from dropping into the pocket 45, as is depicted in phantom in FIG. 5.

A bell-type of inertial member 50 is depicted in the third and fourth embodiments shown in FIGS. 7-9 and FIGS. 10-11, respectively. In the third embodiment, the plunger 32 is again supported within a housing 31 for linear movement into the housing 31 in response to engagement with the cam surface of the latch lever (not shown). The plunger is biased outwardly against the latch lever (not shown) by the biasing spring 55 which sits in a chamber 56 formed in the inward end of the plunger 31 and seats against the interior of the inertial bell 50. Thus, the biasing spring 55 serves to push the plunger 32 outwardly of the housing 31 into engagement with the latching mechanism (not shown), with the shoulders 54 preventing the plunger from exiting the housing 31, while pressing the inertial bell 50 inwardly against the housing 31.

Figures 7, 8, 9:
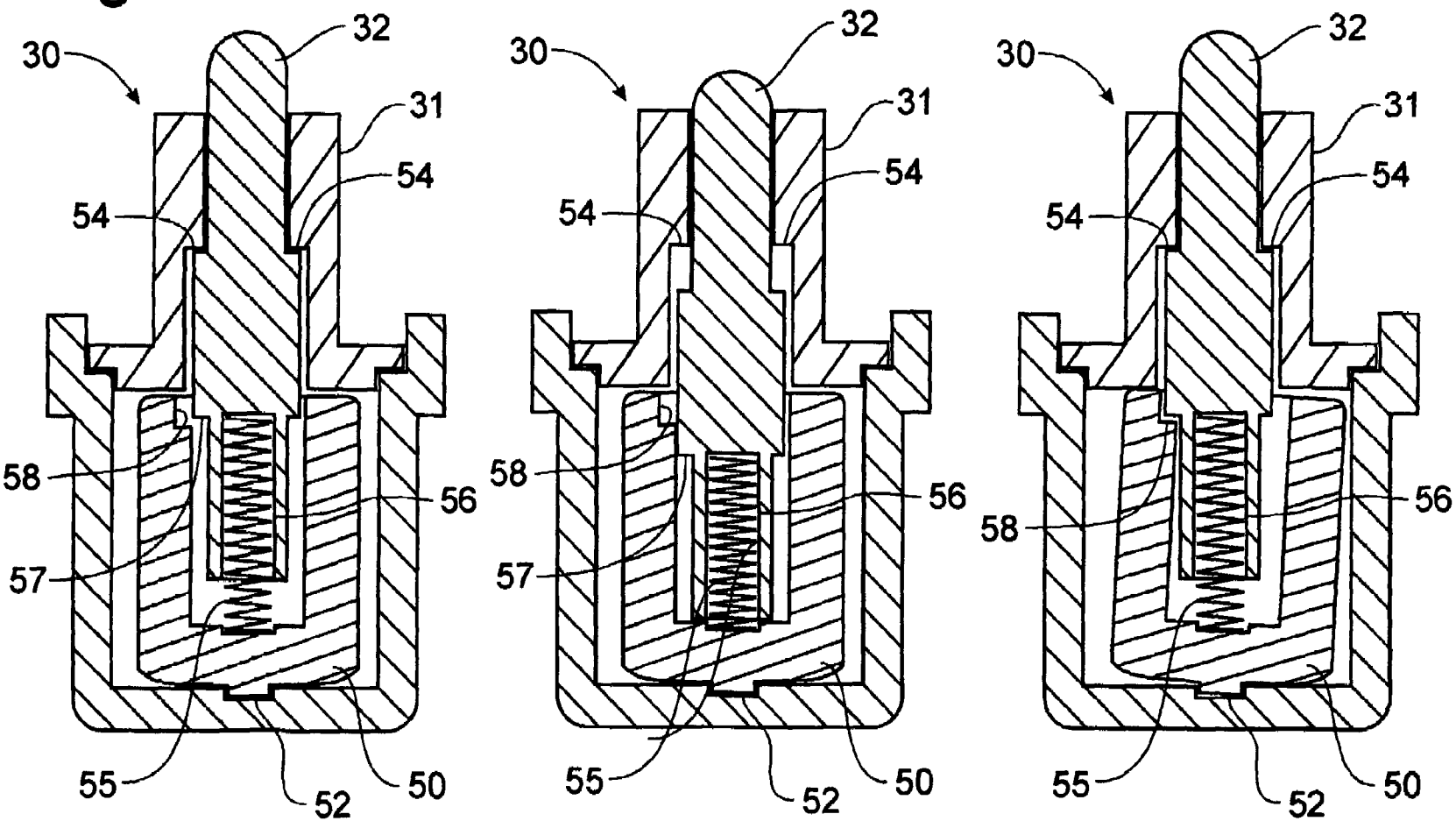
FIG. 7 is a cross-sectional view of a third embodiment of the blocking apparatus with the components in a normal operative position as depicted in FIG. 2.
FIG. 8 is a cross-sectional view of the third embodiment of the blocking apparatus depicted in FIG. 7 with the plunger retracted into the inertial mass due to engagement with the cam surface on the latch lever.
FIG. 9 is a cross-sectional view of the third embodiment depicted in FIG. 7 but with the inertial mass pivoted due to an external application of crash forces to block the movement of the plunger and the engaged latch lever.

The inertial bell 50 pivotally engages the housing 31 at the depression 52 formed therein to be engaged with the inertial bell 50. When the plunger 32 is moved inwardly into the housing 31, as is depicted in FIG. 8, the biasing spring 55 compresses while the plunger retracts into the interior of the inertial bell 50. When the plunger 32 is pushed outwardly and a crash event is incurred, the external crash forces cause the inertial bell 50 to tip or pivot to the side, as is represented in FIG. 9. A relief pocket 58 is formed on one side of the inertial bell 50 to allow the inertial bell 50 to slide beneath the lip 57 formed in the plunger 32 and prevent the inward movement of the plunger 32 and the corresponding undesired operation of the latching mechanism.

One skilled in the art will recognize that the relief pocket 58 need only be formed on one side of the inertial bell 50 to correspond to the direction of the inertial crash forces that would cause an actuation movement of the latch lever. If the inertial crash forces were directed in the opposite direction, the latch lever will not be urged into an actuating position and the blocking apparatus 30 does not need to be activated.

Figure 11:
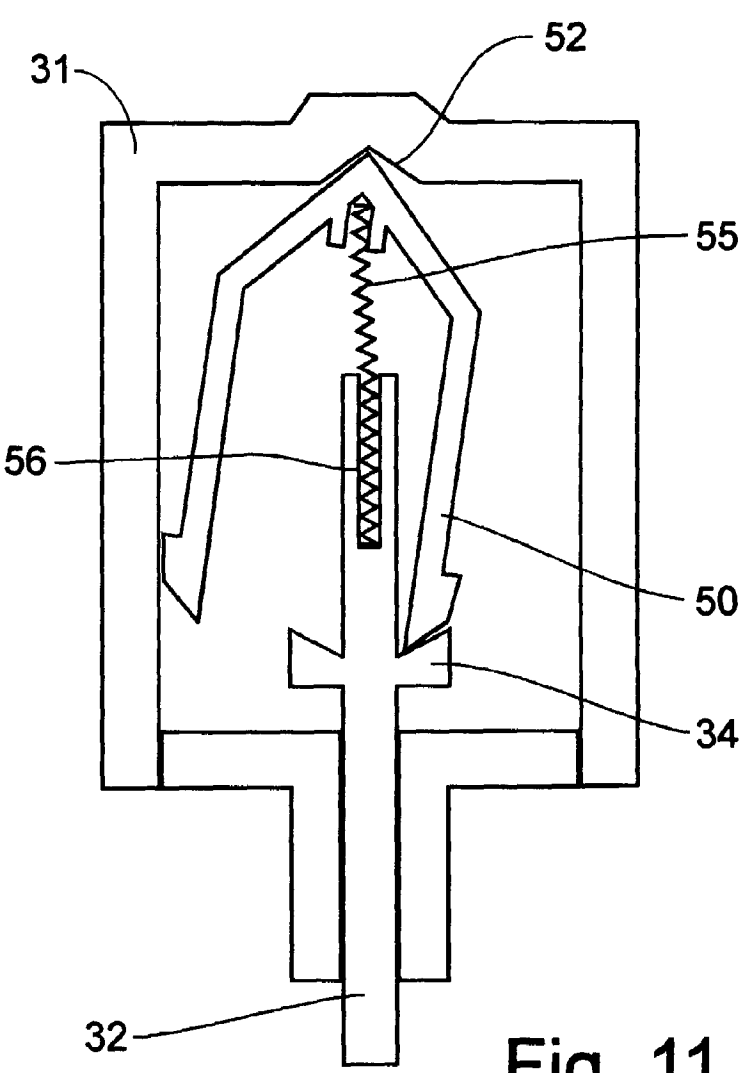
FIG. 11 is a cross-sectional view of the fourth embodiment of the blocking apparatus depicted in FIG. 10, but with the inertial bell pivoted into a blocking position.
Figure 10:
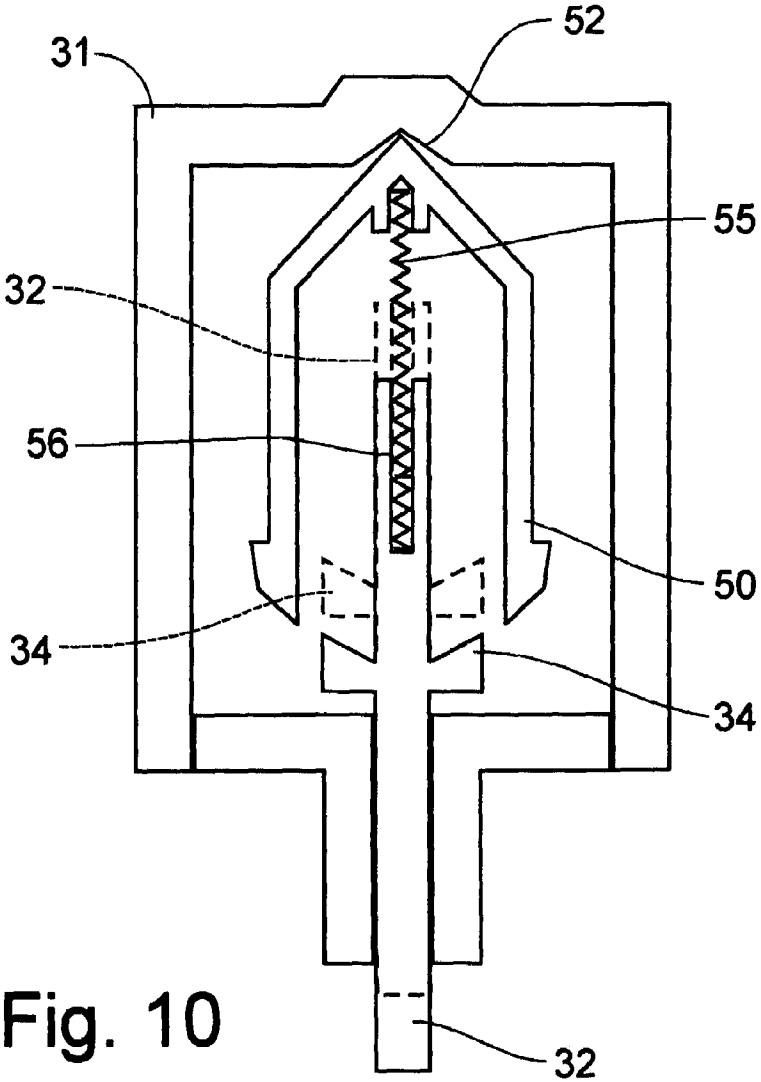
FIG. 10 is a cross-sectional view of a fourth embodiment of the blocking apparatus in the normal operative position as depicted in FIG. 2, the movement of the plunger induced by the cam surface of the latch lever when the latching mechanism is opened being shown in phantom.

A more simplified version of the inertial bell 50 is depicted in FIGS. 10 and 11 in which the circular inertial bell 50 can activate by pivoting into interference with the plunger flanges 34 to prevent the plunger from moving inwardly into the housing 31. As with the first and second embodiments of the blocking apparatus 30, the flanges 34 restrict movement of the plunger outwardly from the housing 31, while the biasing spring 50 urges the plunger 32 into engagement with the latch lever (not shown). If the plunger 32 is already retracted inwardly into the housing 31 by the cam surface of the latch lever, the plunger flanges 34 prevent the inertial bell 50 from pivoting into an interfering position. Once the crash event has subsided, the biasing spring 55 is operable to move the inertial bell 50 back into the normal position shown in FIG. 10 from the interfering or blocking position depicted in FIG. 11.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A blocking apparatus to prevent undesired motion of a door latching mechanism in an automobile, said door latching mechanism having a movable member, comprising:

a housing;

a plunger supported in said housing for linear movement extending into said housing, said plunger being biased outwardly relative to said housing into engagement with said movable member, said movable member having a cam surface positioned for engagement with said plunger when moved in a first direction;

an inertial member pivotally supported for movement relative to said plunger between a normal position in which said plunger is free to move inwardly relative to said housing when engaged by said cam surface, and a blocking position in which said inertial member prevents said inward movement of said plunger; and a biasing spring extending between said plunger and said inertial member to bias said plunger toward said movable member and to urge said inertial member into engagement with said housing.

2. The blocking apparatus of claim 1 wherein said inertial member is pivotally supported in said housing.

3. The blocking apparatus of claim 2 wherein said inertial member is formed with a cavity into which said plunger extends when said inertial member is in said normal position and said plunger is engaged with said cam surface.

4. The blocking apparatus of claim 2 wherein said inertial member is bell-shaped and positioned to pivot into an interfering position with respect to said inward plunger movement when external crash forces are encountered.

5. The blocking apparatus of claim 4 wherein said plunger is formed with a chamber in which said biasing spring is seated.

6. A door latch mechanism for an automotive vehicle having a door movable between an opened position and a closed position, said door latch mechanism being selectively operable to secure said door in said closed position, comprising:

a latch lever movable to effect a release of said door latch mechanism and allow said door to move from said closed position to said opened position; and a blocking apparatus cooperable with said latch lever to prevent movement of said latch lever during a crash event in which external crash forces are imposed on said vehicle, said blocking apparatus including:

a housing;

a plunger formed with a flange and supported in said housing for linear movement extending into said housing, said plunger being biased outwardly relative to said housing into engagement with said latch lever, said latch lever having a cam surface positioned for engagement with said plunger when moved in a first direction; and a bell-shaped inertial member pivotally supported for movement relative to said plunger between a normal position in which said plunger is free to move inwardly relative to said housing when engaged by said cam surface, and a blocking position in which said inertial member pivots into engagement with said plunger flange to prevent said inward movement of said plunger.

7. The door latch mechanism of claim 6 wherein said inertial member is pivotally connected to said housing and is formed with a cavity into which said plunger extends when said inertial member is in said normal position and said plunger is engaged with said cam surface.

8. The door latch mechanism of claim 6 further comprising a biasing spring extending between said plunger and said inertial member and being operable to urge both said plunger outwardly into engagement with said latch lever and said bell-shaped inertial member into pivotal engagement with said housing.

9. In an automobile having a frame on which is mounted at least one door movable between an opened position and a closed position, said door including a latching mechanism selectively operable to secure said at least one door in said closed position, said latching mechanism including a latch lever movable to actuate said latching mechanism to release said door from said closed position, the improvement comprising:

said latch lever being formed with a cam surface;

a plunger engaged with said latch lever such that the movement of said latch lever engages said plunger with said cam surface to cause said plunger to move inwardly with respect to a housing in which said plunger is mounted; and a blocking member having a cavity and being pivotally mounted in said housing, said plunger being located within said cavity and having a flange that is movable into and out of said cavity when said latch lever moves said plunger inwardly, pivotal movement of said blocking member being operable to engage said plunger flange with said blocking member to block the movement of said plunger flange into said cavity when said automobile incurs a crash event, said latch lever being unable to move to actuate said latching mechanism unless said plunger is free to retract into said cavity.

10. The automobile of claim 9 wherein said blocking member is movable between a normal position in which said plunger can extend into said cavity formed in said blocking member when said plunger is engaged with said cam surface, and a blocking position in which said plunger is prevented from moving into said cavity, said blocking member being biased into said normal position by a centering spring mechanism.

11. The automobile of claim 9 wherein said blocking member is formed as a bell-shaped structure defining an internal cavity into which said plunger can extend when engaged with said cam surface, a biasing spring extending between said plunger and said blocking member to urge said plunger outwardly from said housing toward engagement with said latch lever and to urge said blocking member into pivotal engagement with said housing.

* * * * *